US005743334A

United States Patent [19]

Nelson

[11] Patent Number: 5,743,334

[45] Date of Patent: Apr. 28, 1998

[54] EVALUATING A HYDRAULIC FRACTURE TREATMENT IN A WELLBORE

[75] Inventor: Donald G. Nelson, Bakersfield, Calif.

[73] Assignee: Chevron U.S.A. Inc., San Francisco, Calif.

[21] Appl. No.: 627,564

[22] Filed: Apr. 4, 1996

[51] Int. Cl.[6] ..... E21B 47/06; E21B 47/10

[52] U.S. Cl. ..... 166/250.07; 73/152.17; 73/152.51; 166/250.1; 166/250.17

[58] Field of Search ..... 166/250.02, 250.07, 166/250.1, 250.17; 73/152.05, 152.17, 152.51, 152.54

[56] References Cited

U.S. PATENT DOCUMENTS

| | | | |
|---|---|---|---|
| 3,248,938 | 5/1966 | Hill et al. | 73/152.51 |
| 3,602,308 | 8/1971 | Vincent | 166/281 |
| 3,872,717 | 3/1975 | Fox | 73/84 |
| 3,934,468 | 1/1976 | Brieger . | |
| 4,149,409 | 4/1979 | Serata . | |
| 4,372,380 | 2/1983 | Smith et al. | 166/308 X |
| 4,398,416 | 8/1983 | Nolte . | |
| 4,442,895 | 4/1984 | Lagus et al. | 166/308 X |
| 4,453,595 | 6/1984 | Lagus et al. | 166/308 X |
| 4,461,171 | 7/1984 | de la Cruz . | |
| 4,566,535 | 1/1986 | Sanford | 166/250.17 X |
| 4,660,415 | 4/1987 | Bouteca . | |
| 4,665,984 | 5/1987 | Hayashi et al. | 166/308 X |
| 4,806,153 | 2/1989 | Sakai et al. | 175/50 |
| 4,836,280 | 6/1989 | Soliman | 166/308 X |
| 4,843,878 | 7/1989 | Purfurst et al. . | |
| 4,860,581 | 8/1989 | Zimmerman et al. . | |
| 4,898,241 | 2/1990 | Wittrisch | 166/66 X |
| 4,936,139 | 6/1990 | Zimmerman et al. | 175/40 |
| 5,005,643 | 4/1991 | Soliman et al. | 166/308 X |
| 5,031,163 | 7/1991 | Holzhausen et al. | 367/35 |
| 5,042,595 | 8/1991 | Ladanyi | 175/50 |
| 5,165,274 | 11/1992 | Thiercelin . | |
| 5,165,276 | 11/1992 | Thiercelin | 166/308 X |
| 5,287,741 | 2/1994 | Schultz et al. | 73/152.51 |
| 5,295,393 | 3/1994 | Thiercelin | 73/152.51 |
| 5,335,542 | 8/1994 | Ramakrishnan | 166/250.02 X |
| 5,337,821 | 8/1994 | Peterson | 166/250.07 |
| 5,417,103 | 5/1995 | Hunter et al. | 73/37 |
| 5,472,049 | 12/1995 | Chaffee et al. | 166/250.1 |
| 5,477,922 | 12/1995 | Rochon | 166/250.02 |
| 5,549,159 | 8/1996 | Shwe et al. | 166/250.02 |

*Primary Examiner*—George A. Suchfield
*Attorney, Agent, or Firm*—W. Keith Turner; A. Stephen Zavell; Rodney Brown

[57] ABSTRACT

A method is provided for evaluating the quality of a hydraulic fracture treatment performed in a completed wellbore penetrating a subterranean hydrocarbon-bearing formation. The method is initiated by creating a pressure differential or utilizing an existing pressure differential between the wellbore and the formation and placing a lower packer and an upper packer in the wellbore. The lower and upper packers are positioned in the wellbore at or near the bottom of the producing interval to enclose one or more lower perforations within a wellbore chamber sealed to the remainder of the wellbore. Pressure values of the wellbore chamber are measured for a predetermined time period and then the lower and upper packers are repositioned to enclose the next one or more perforations in sequence within a new wellbore chamber. This procedure is repeated until pressure values have been measured in all wellbore chambers enclosing perforations of interest. The pressure values are used to the determine rate of pressure change in each wellbore chamber. By comparing the rates of pressure change of the wellbore chambers, the character and quality of a fracture and/or fracture network at the casing perforations can be evaluated. A relatively high rate of pressure change in a given wellbore chamber is indicative that the one or more casing perforations of the wellbore chamber are in fluid communication with one or more high quality fractures having a high degree of networking and/or vertical connectivity with other casing perforations. A relatively low rate of pressure change in a given wellbore chamber is indicative that the one or more casing perforations of the wellbore chamber are in fluid communication with one or more low quality fractures having little or no networking and/or vertical connectivity.

20 Claims, 7 Drawing Sheets

EVALUATING A HYDRAULIC FRACTURE TREATMENT IN A WELLBORE

TECHNICAL FIELD

The present invention relates generally to fracture treatments of subterranean hydrocarbon-bearing formations, and more particularly to a method for evaluating a hydraulic fracture treatment in a wellbore penetrating a subterranean hydrocarbon-bearing formation.

BACKGROUND OF THE INVENTION

A hydraulic fracture treatment is a conventional stimulation technique for improving the productivity of a hydrocarbon production wellbore. In accordance with the treatment, a one or more hydraulic fractures are typically placed through casing perforations in the wellbore by means of a fracing fluid. An effective hydraulic fracture treatment desirably produces a fracture or a plurality of fractures in an interconnected fracture network, wherein the fracture or fracture network extends from the perforations out into the hydrocarbon-bearing stratum of the formation. An idealized hydraulic fracture treatment results in a single vertical fracture plane containing the fracture or fracture network vertically connected to all of the casing perforations that provides fluid communication between the perforations. In practice, however, conventional hydraulic fracture treatments often produce multiple disconnected fractures, rather than a single interconnected fracture or network of fractures, that provide fluid communication between only a limited number of perforations in the wellbore. Consequently, such a hydraulic fracture treatment results in less than optimal fracture length, width, conductivity, vertical coverage and placement efficiency. A substandard hydraulic fracture treatment can be remedied by refracing the wellbore through the insufficiently stimulated perforations, but it is first necessary to identify these perforations. Identification of unstimulated perforations can also lead to recognition of the underlying causes for substandard hydraulic fracture treatments, thereby contributing to the general body of knowledge regarding hydraulic fracture treatments and potentially improving the effectiveness of future treatments and fracture simulation models.

A number of techniques are presently available for evaluating hydraulic fracture treatments, but none of these techniques have proven to be entirely satisfactory for their intended purpose. Among the known evaluation techniques are seismic interpretation, direct observation of the formation by coring, interpretation of the pressure responses during the actual hydraulic fracture treatment, tiltmeter measurements of the fractures, microfrac stress profiling, post-frac radioactive tracer surveys, production logging, and pressure transient analysis of the entire combined completion interval after a production or injection period.

From the foregoing, it is apparent that a need remains for an alternate method of evaluating the effectiveness of a hydraulic fracture treatment in a wellbore. Accordingly, it is an object of the present invention to provide a method of determining the degree of fluid communication between a subterranean formation and a wellbore penetrating the formation. In particular, it is an object of the present invention to provide a method of evaluating the effectiveness of a hydraulic fracture treatment in a wellbore by directly obtaining pressure measurements therein, while the wellbore is in a non-equilibrium pressure condition relative to the formation. More particularly, it is an object of the present invention to provide a method of determining whether a plurality of casing perforations in a wellbore are vertically connected to a single fracture or fracture network. It is another object of the present invention to provide a method of determining whether a casing perforation in a wellbore is insufficiently stimulated or unstimulated by a hydraulic fracture treatment. It is still another object of the present invention to provide a method of accurately identifying intervals in a wellbore that are candidates for refracing. It is yet another object of the present invention to provide a method of acquiring empirical fracture data to improve fracture simulation models and post-fracture pressure transient analytical models. These objects and others are accomplished in accordance with the invention described hereafter.

SUMMARY OF THE INVENTION

The present invention is a method for evaluating the degree of fluid communication between a subterranean hydrocarbon-bearing formation and a wellbore across a wellbore face that is at the interface of the formation and wellbore. The method requires the existence of a pressure differential between the wellbore and the formation. A lower fluid seal is placed across a first lower cross-section of the wellbore at a first lower point of the wellbore face to block fluid flow across the first lower cross-section. An upper fluid seal is also placed across a first upper cross-section of the wellbore at a first upper point of the wellbore face spaced a first wellbore distance from the first lower point to block fluid flow across the second cross-section. The resulting lower and upper seals define a first wellbore chamber bounded by the lower and upper seals and a first segment of the wellbore face positioned between the first lower and upper points. In a preferred embodiment, the lower and upper seals are lower and upper packers in a dual packer assembly. A plurality of first pressure values are measured in the first wellbore chamber over a first time period to obtain a first pressure rate.

The lower and upper seals are then repositioned to a second lower point and a second upper point of the wellbore face. The lower and upper seals define a second wellbore chamber bounded by the lower and upper seals and a second segment of the wellbore face positioned between the second lower and upper points. The first and second wellbore chambers are preferably aligned in vertical sequence along the length of the wellbore. A plurality of second pressure values are measured in the second wellbore chamber over a second time period to obtain a second pressure rate and the first pressure rate is compared to the second pressure rate.

The above-described procedure of repositioning the lower and upper seals to establish another sequential wellbore chamber and measuring the pressure values therein over a time period time to obtain a pressure rate is repeated over substantially the entire length of the production or injection interval within the wellbore. The pressure rate of each wellbore chamber is compared to the pressure rates of the other wellbore chambers to identify sections of the wellbore having a high degree of fluid communication with the formation.

The method of the present invention is particularly effective for evaluating the effectiveness of a hydraulic fracture treatment in a completed wellbore having a perforated casing positioned at the wellbore face. Each wellbore chamber is selected to correspond to the location of one or more different casing perforations. A relatively high pressure rate in a given wellbore chamber indicates that the chamber contains a casing perforation in fluid communication with a fracture network having a higher quality of fracturing and/or fracture connectivity than a wellbore chamber having a relatively low pressure rate. The method of the present invention will be further understood from the following detailed description and accompanying drawings.

DESCRIPTION OF PREFERRED EMBODIMENTS

The present invention relates generally to a method for determining the degree of fluid communication between a subterranean fluid-bearing formation and a wellbore penetrating the formation. The method is specifically applicable to evaluating the quality of a hydraulic fracture treatment performed in a wellbore penetrating a subterranean hydrocarbon-bearing formation. In accordance with one embodiment of the invention, the method is applied to a completed production wellbore penetrating a subterranean hydrocarbon-bearing formation, wherein the casing of the wellbore has been cemented and perforated in the production zone of the wellbore and a hydraulic fracture treatment has been performed through the perforations to provide fractures extending into the formation from the wellbore. For purposes of illustration, the method of the present invention is described hereafter with reference to such an embodiment. It is readily apparent to the skilled artisan, however, that the instant teaching can be adapted to other wellbores in fluid communication with a fluid-bearing subterranean formation penetrated thereby. For example, the method of the present invention can be applied to cased or uncased wellbores, production or injection wellbores, naturally or hydraulically fractured wellbores, unfractured wellbores, vertical, slanted or horizontal wellbores.

Figure 1A:
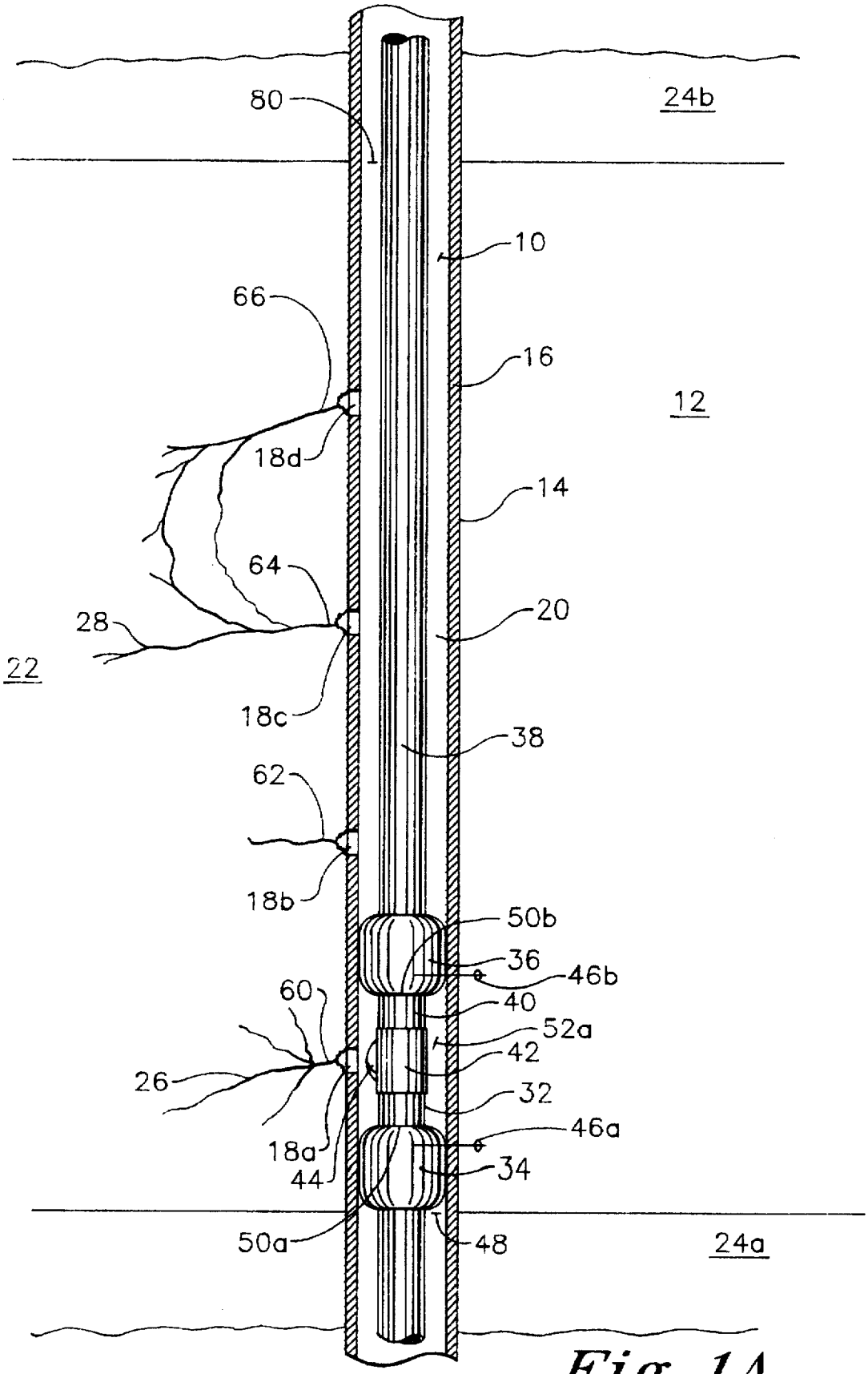
FIG. 1A is a schematic cross-sectional representation of a packer assembly at a first position in a wellbore in accordance with the method of the present invention.

Referring to FIG. 1A, a cross section of a completed vertical hydrocarbon production wellbore 10 is shown penetrating a subterranean hydrocarbon-bearing formation 12. The interface between the wellbore 10 and the formation 12 is termed the wellbore face 14. A conventional tubular metal casing 16 is positioned at the wellbore face 14. For purposes of the present description, the term "wellbore face" is defined to encompass both the earthen face of the wellbore 10 and the adjoining casing 16. For uncased wellbores, the "wellbore face" is defined as the earthen face alone. A plurality of perforations **18*a*, 18*b*, 18*c*, 18*d* are provided through the casing 16 in the producing interval 20 of the wellbore 10 that enable fluid communication between the wellbore 10 and the formation 12 across the wellbore face 14. The producing interval 20 of the wellbore 10 is aligned with a hydrocarbon-bearing stratum 22 of the formation 12. The hydrocarbon-bearing stratum 22 is bounded by substantially impervious non-hydrocarbon-bearing lower and upper strata 24*a*, 24*b***.

The wellbore 10 of FIG. 1A has undergone a hydraulic fracture treatment in accordance with any conventional manner, such treatments being well known to the skilled artisan. The hydraulic fracture treatment provides a plurality of fracture networks 26, 28 extending out in three dimensions into the near wellbore region of the hydrocarbon-bearing stratum 22, although the fracture networks 26, 28 are shown in FIG. 1A in two dimensions for purposes of illustrative clarity. The fracture network 26 extends from the perforation **18*a* and the fracture network 28 extends jointly from both perforations 18*c*, 18*d*. The near wellbore region is defined herein as the portion of the formation 12 typically extending radially up to about 15 feet from the wellbore face 14. It is noted that an ideal hydraulic fracture treatment effectively produces a single fracture or a plurality of fractures having a high degree of vertical connectivity therebetween, thereby forming a fracture or a network of fractures within a single vertical fracture plane of the hydrocarbon-bearing stratum near the wellbore. The fracture or fracture network of the ideal treatment is in fluid communication with all of the casing perforations in the wellbore. As shown herein, however, the hydraulic fracture treatment performed in the wellbore 10 is less than ideal, lacking a single continuous vertical fracture plane in fluid communication with all of the perforations 18*a*, 18*b*, 18*c*, 18*d***, as will be detected by the method of the present invention in a manner described hereafter.

The method of the present invention is initiated by creating a pressure differential, or utilizing an existing pressure differential, between the wellbore 10 and the formation 12 such that the wellbore and formation pressures are not in equilibrium. The pressure differential can be achieved by means of a pressure buildup mode following a production period, a pressure falloff mode during an injection period or after a well control operation, a simultaneous pressure drawdown and buildup mode due to crossflow, or real-time injection of a non-damaging fluid into the wellbore through a tool string. In any case, a conventional dual packer assembly 32 is placed in the wellbore 10 experiencing a non-equilibrium pressure state relative to the formation 12. The dual packer assembly 32 comprises a lower packer 34 and an upper packer 36 mounted on a tool string 38. The connective portion 40 of the tool string 38 positioned between the lower packer 34 and the upper packer 36 includes a mandrel sub 42 that retains a pressure measuring device 44. The pressure measuring device 44 can be substantially any means known in the art for instantaneously or continuously measuring fluid pressure in the wellbore 10. Nevertheless, a preferred pressure measuring device is a pair of remote downhole pressure quartz memory gauges from which pressure values in the wellbore 10 can be read and recorded upon removal of the gauges from the wellbore. Alternatively, the pressure measuring device can be in communication with a data display and/or recorder (not shown) at the surface of the wellbore 10 for instantaneous reading of the pressure values. Although not shown, it is further apparent to the skilled artisan that the connective portion 40 of the tool string 38 can include other subs and/or equipment as desired by the practitioner of the present invention. In all cases, except where the pressure differential is achieved by real-time fluid injection, the connective portion 40 of the tool string 38 is advantageously formed from entirely closed or sealed tubing to ensure proper pressure measurements in the wellbore 10 as described hereafter.

The lower packer 34 is initially positioned beneath the first perforation 18*a* at a first lower point 46*a* of the wellbore face 14 at or near the bottom 48 of the producing interval 20. The lower packer 34 produces a fluid seal across a first lower cross-sectional plane 50*a* in the wellbore 10 aligned with the first lower point 46*a* to substantially block fluid flow across the first lower cross-sectional plane 50*a*. An upper packer 36 is correspondingly positioned above the first perforation 18*a*, but below the second perforation 18*b*, at a first upper point 46*b* of the wellbore face 14. The upper packer 36 produces a fluid seal across a first upper cross-sectional plane 50*b* in the wellbore 10 aligned with the first upper point 46*b* to substantially block fluid flow across the first upper cross-sectional plane 50*b*.

The lower and upper packers 34, 36, positioned as shown in FIG. 1A, define a first wellbore chamber 52*a* in direct fluid and pressure isolation from the remainder of the wellbore 10. By direct fluid and pressure isolation, it is meant that neither fluid nor pressure is directly communicated between the first wellbore chamber 52*a* and the remainder of the wellbore 10 via the wellbore 10, although fluid or pressure can be indirectly communicated between the first wellbore chamber 52*a* and the remainder of the wellbore 10 via the perforations 18*a*, 18*b*, 18*c*, 18*d* and the hydrocarbon-bearing stratum 22. The first wellbore chamber 52*a* is bounded by the lower and upper packers 34, 36 at its upper and lower ends, respectively, and on its sides by a segment of the wellbore face 14 positioned between the first lower and upper points 46*a*, 46*b*. Fluid and pressure communication is enabled between the first wellbore chamber 52*a* and the hydrocarbon-bearing stratum 22 via the first perforation 18*a* across the wellbore face 14. It is noted that a preexisting first hydraulic fracture 60 of the first fracture network 26 enhances fluid and pressure communication between the first wellbore chamber 52*a* and the hydrocarbon-bearing stratum 22 across the wellbore face 14. The preexisting first hydraulic fracture 60 is formed by the prior hydraulic fracture treatment and opens into the first perforation 18*a* at one end while branching into a plurality of secondary fractures further comprising the first fracture network 26 at its other end. It is noted that preexisting fractures 62, 64, 66 are also provided in association with the perforations 18*b*, 18*c*, 18*d*, respectively, and are described in detail hereafter.

The pressure measuring device 44 is positioned in the first wellbore chamber 52*a* to either periodically or continuously measure a plurality of first pressure values in the first wellbore chamber 52*a* throughout a predetermined first time interval. The first time interval is preferably relatively short, typically within a range of about 2 to about 5 minutes, and preferably within a range of about 3 to about 4 minutes. If the pressure differential is achieved by real-time fluid injection, the first time interval may be somewhat longer up to about an hour or more. In any case, the first pressure values are recorded for subsequent analysis as described hereafter.

Figure 1B:
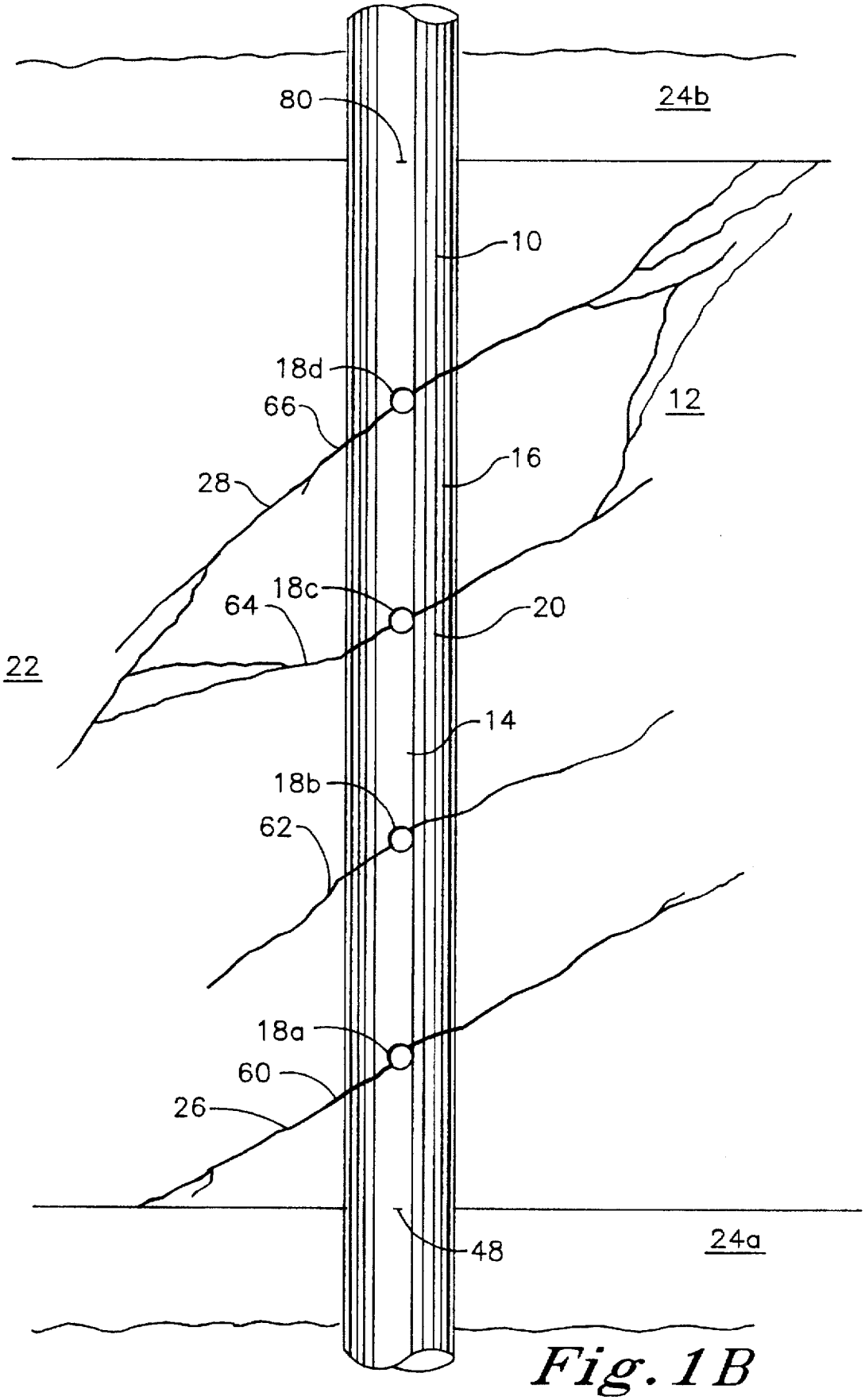
FIG. 1B is a schematic representation of the wellbore of FIG. 1A, wherein the view of FIG. 1B is rotated 95° from the view of FIG. 1A to show the vertical dip of fractures extending from the wellbore.

As noted above, FIG. 1A shows the fractures 60, 62, 64, 66 schematically in simplified two-dimensional cross section. It is apparent, however, by viewing the wellbore in 45° of rotation relative to FIG. 1A, as shown in FIG. 1B, that the fractures 60, 62, 64, 66 can dip in a plane that intersects the path of the wellbore 10 with significant height growth, but limited connectivity.

Figure 2:
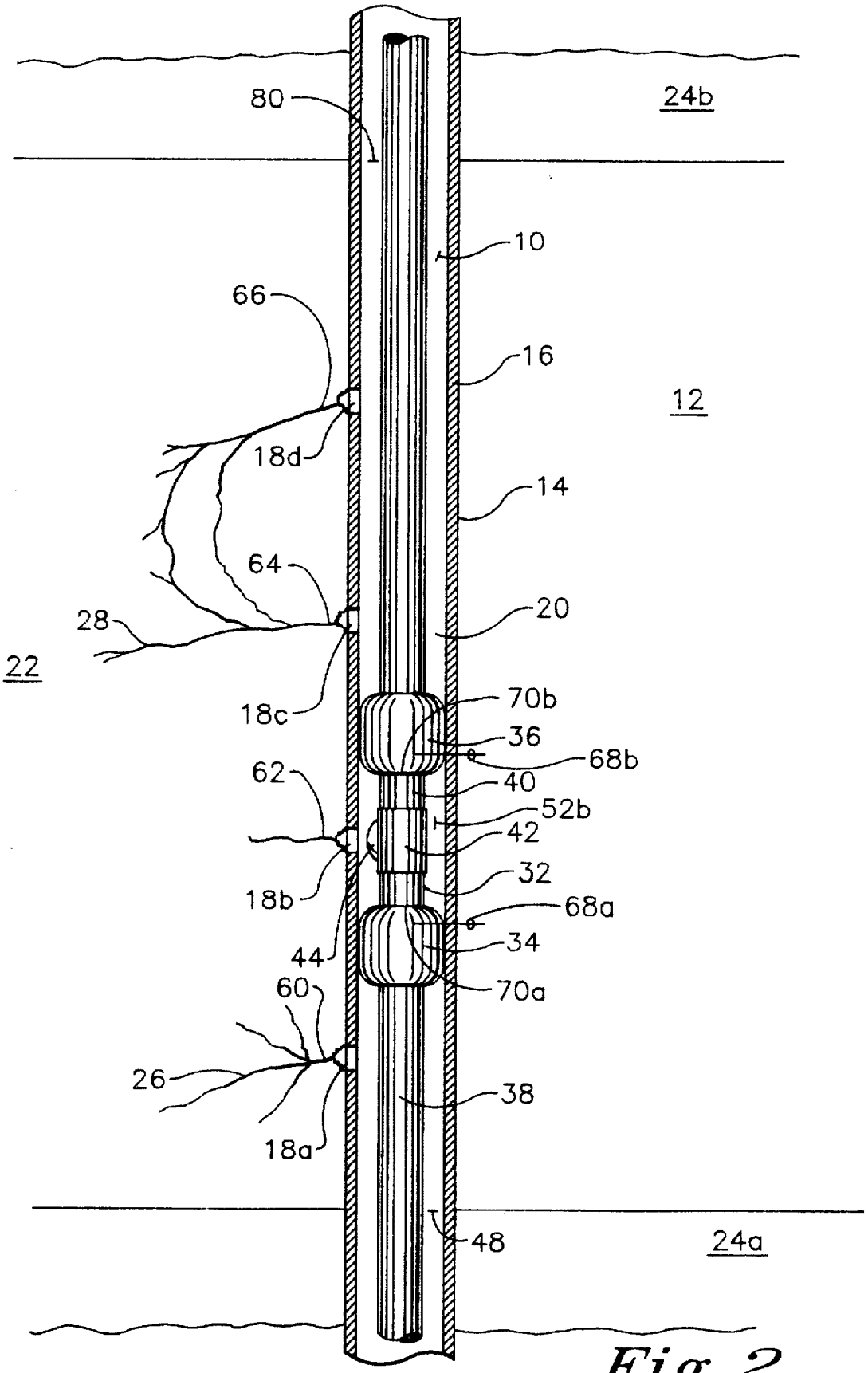
FIG. 2 is a schematic cross-sectional representation of the packer assembly of FIG. 1A repositioned at a second position in the wellbore in accordance with the method of the present invention.

Referring to FIG. 2, the lower and upper packers 34, 36 are repositioned in the wellbore 10 upon completion of the first time interval by raising the packers 34, 36 in correspondence with the position of the second perforation 18*b*. The second perforation 18*b* is the adjacent, next higher perforation in vertical sequence to the first perforation 18*a*. The lower packer 34 is positioned at a second lower point 68*a* of the wellbore face 14 beneath the second perforation 18*b*, but above the first perforation 18*a*. The lower packer 34 produces a fluid seal across a second lower cross-sectional plane 70*a* in the wellbore 10 aligned with the second lower point 68*a* to substantially block fluid flow across the second lower cross-sectional plane 70*a*. The upper packer 36 is correspondingly positioned above the second perforation 18*b*, but below the third perforation 18*c*, at a second upper point 68*b* of the wellbore face 14. The upper packer 36 produces a fluid seal across a second upper cross-sectional plane 70*b* in the wellbore 10 aligned with the second upper point 68*b* to substantially block fluid flow across the second upper cross-sectional plane 70*b*.

The lower and upper packers 34, 36, positioned as shown in FIG. 2, define a second wellbore chamber 52*b* in direct fluid and pressure isolation from the remainder of the wellbore 10. The second wellbore chamber 52*b* is bounded by the lower and upper packers 34, 36 at its upper and lower ends, respectively, and on its sides by a segment of the wellbore face 14 positioned between the second lower and upper points 68*a*, 68*b*. Fluid and pressure communication is enabled between the second wellbore chamber 52*b* and the hydrocarbon-bearing stratum 22 via the second perforation 18*b* across the wellbore face 14. It is noted that a preexisting second hydraulic fracture 62 enhances fluid and pressure communication between the second wellbore chamber 52*b* and the hydrocarbon-bearing stratum 22 across the wellbore face 14. The preexisting second hydraulic fracture 62 is formed by the prior hydraulic fracture treatment and opens into the second perforation 18*b* at one end while substantially terminating without branching at its other end.

The pressure measuring device 44 positioned in the second wellbore chamber 52*b* measures a plurality of second pressure values in the second wellbore chamber 52*b* throughout a predetermined second time interval. The second time interval is preferably about equal to the first time interval. The second pressure values are likewise recorded for subsequent analysis as described hereafter.

Figure 3:
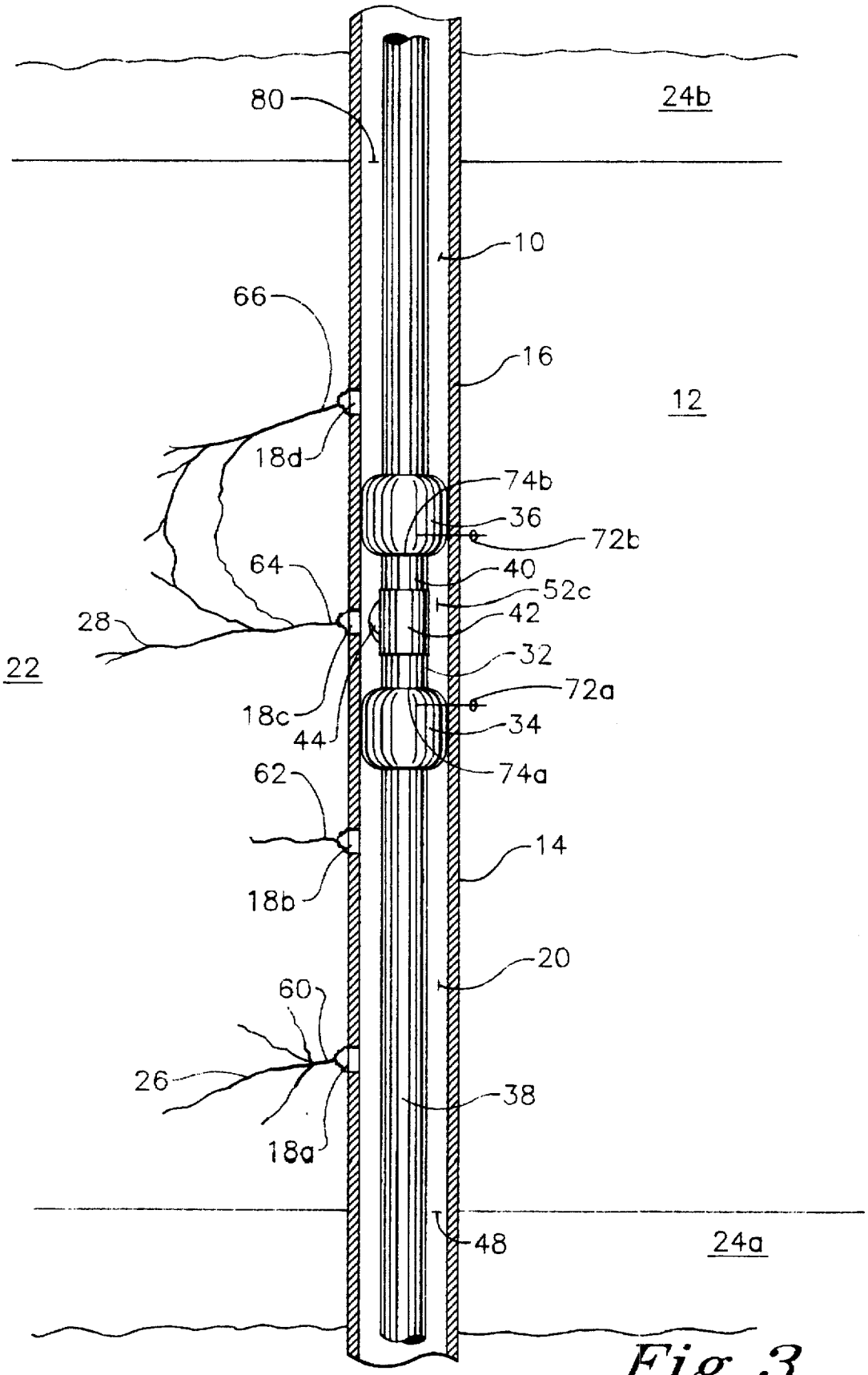
FIG. 3 is a schematic cross-sectional representation of the packer assembly of FIG. 1A repositioned at a third position in the wellbore in accordance with the method of the present invention.

Referring to FIG. 3, the lower and upper packers 34, 36 are again repositioned in the wellbore 10 upon completion of the second time interval by raising the packers 34, 36 in correspondence with the position of the third perforation 18*c*. The third perforation 18*c* is the adjacent, next higher perforation in vertical sequence to the second perforation 18*b*. The lower packer 34 is positioned at a third lower point 72*a* of the wellbore face 14 beneath the third perforation 18*c*, but above the third perforation 18*b*. The lower packer 34 produces a fluid seal across a third lower cross-sectional plane 74*a* in the wellbore 10 aligned with the third lower point 72*a* to substantially block fluid flow across the third lower cross-sectional plane 74*a*. The upper packer 36 is correspondingly positioned above the third perforation 18*c*, but below the fourth perforation 18*d*, at a third upper point 72*b* of the wellbore face 14. The upper packer 36 produces a fluid seal across a third upper cross-sectional plane 74*b* in the wellbore 10 aligned with the third upper point 72b to substantially block fluid flow across the third upper cross-sectional plane 74b.

The lower and upper packers 34, 36, positioned as shown in FIG. 3, define a third wellbore chamber 52c in direct fluid and pressure isolation from the remainder of the wellbore 10. The third wellbore chamber 52c is bounded by the lower and upper packers 34, 36 at its upper and lower ends, respectively, and on its sides by a segment of the wellbore face 14 positioned between the third lower and upper points 72a, 72b. Fluid and pressure communication is enabled between the third wellbore chamber 52c and the hydrocarbon-bearing stratum 22 via the third perforation 18c across the wellbore face 14. It is noted that a preexisting third hydraulic fracture 64 enhances fluid and pressure communication between the third wellbore chamber 52c and the hydrocarbon-bearing stratum 22 across the wellbore face 14. The preexisting third hydraulic fracture 64 is formed by the prior hydraulic fracture treatment and opens into the third perforation 18c at one end while branching into a plurality of secondary fractures further comprising the second fracture network 28 at its other end.

The pressure measuring device 44 positioned in the third wellbore chamber 52c measures a plurality of third pressure values in the third wellbore chamber 52c throughout a predetermined third time interval. The third time interval is preferably about equal to the first time interval. The third pressure values are recorded for subsequent analysis as described hereafter.

Figure 4:
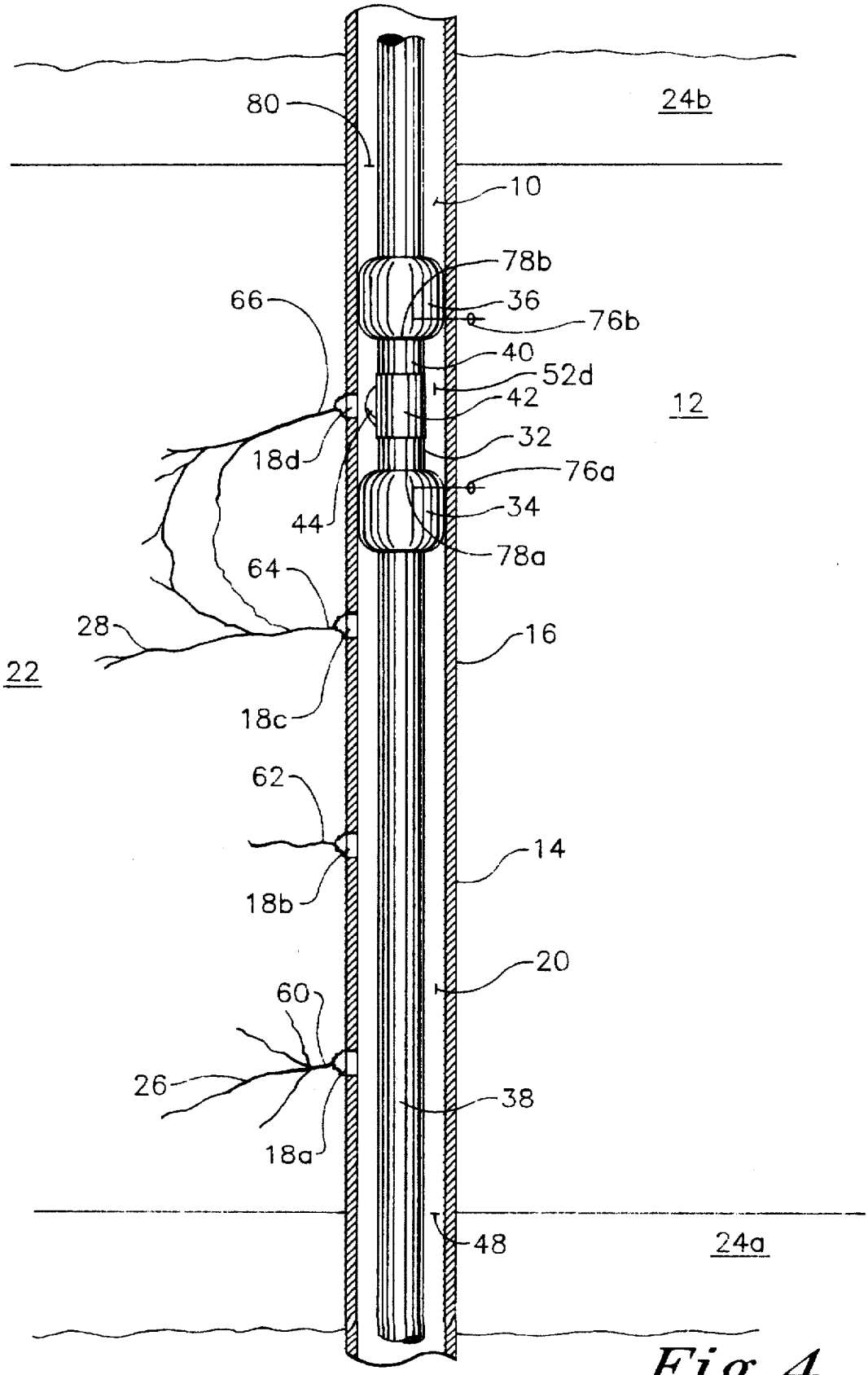
FIG. 4 is a schematic cross-sectional representation of the packer assembly of FIG. 1A repositioned at a fourth position in the wellbore in accordance with the method of the present invention.

Referring to FIG. 4, the lower and upper packers 34, 36 are finally repositioned in the wellbore 10 upon completion of the third time interval by raising the packers 34, 36 in correspondence with the position of the fourth perforation 18d. The fourth perforation 18d is the adjacent, next higher and final perforation in vertical sequence to the third perforation 18c. The lower packer 34 is positioned at a fourth lower point 76a of the wellbore face 14 beneath the fourth perforation 18d, but above the third perforation 18c. The lower packer 34 produces a fluid seal across a fourth lower cross-sectional plane 78a in the wellbore 10 aligned with the fourth lower point 76a to substantially block fluid flow across the fourth lower cross-sectional plane 78a. The upper packer 36 is correspondingly positioned above the fourth perforation 18d, at or near the top 80 of the producing interval 20. The upper packer 36 produces a fluid seal across a fourth upper cross-sectional plane 78b in the wellbore 10 aligned with the fourth upper point 76b to substantially block fluid flow across the fourth upper cross-sectional plane 78b.

The lower and upper packers 34, 36, positioned as shown in FIG. 4, define a fourth wellbore chamber 52d in direct fluid and pressure isolation from the remainder of the wellbore 10. The fourth wellbore chamber 52d is bounded by the lower and upper packers 34, 36 at its upper and lower ends, respectively, and on its sides by a segment of the wellbore face 14 positioned between the fourth lower and upper points 76a, 76b. Fluid and pressure communication is enabled between the fourth wellbore chamber 52d and the hydrocarbon-bearing stratum 22 via the fourth perforation 18d across the wellbore face 14. It is noted that a preexisting fourth hydraulic fracture 66 enhances fluid and pressure communication between the fourth wellbore chamber 52d and the hydrocarbon-bearing stratum 22 across the wellbore face 14. The preexisting fourth hydraulic fracture 66 is formed by the prior hydraulic fracture treatment and opens into the fourth perforation 18d at one end while branching into a plurality of secondary fractures included within the second fracture network 28 at its other end.

The pressure measuring device 44 positioned in the fourth wellbore chamber 52d measures a plurality of fourth pressure values in the fourth wellbore chamber 52d throughout a predetermined fourth time interval. The fourth time interval is preferably about equal to the first time interval. The fourth pressure values are recorded for subsequent analysis as described hereafter.

Analysis of the recorded first, second, third and fourth pressure values is performed by preparing a pressure profile for each wellbore chamber 52a, 52b, 52c, 52d. The pressure profile is a two-dimensional plot of each first, second, third and fourth pressure values versus time, wherein time is the elapsed time of each corresponding first, second, third and fourth time interval. The pressure profiles are used to determine a rate of pressure change for each wellbore chamber 52a, 52b, 52c, 52d during the respective time interval. By comparing the first rate of pressure change to the second, third and fourth rates, comparing the second rate of pressure change to the first, third and fourth rates and so on for the remaining third and fourth rates of pressure change, the character and quality of the fractures 60, 62, 64, 66 and/or fracture networks 26, 28 at each casing perforation 18a, 18b, 18c, 18d can be evaluated. More particularly, a relatively high rate of pressure change in a given wellbore chamber is indicative that the casing perforation of the wellbore chamber is in fluid communication with high quality fractures having a high degree of networking and/or vertical connectivity with other casing perforations as exemplified by perforations 18c, 18d. Where multiple perforations are connected by a common fracture or fracture network, wellbore chambers containing these perforations will typically exhibit a pressure similar to the wellbore pressure. By comparison, a relatively low rate of pressure change in a given wellbore chamber is indicative that the casing perforation of the wellbore chamber is in fluid communication with low quality fractures having little or no networking and/or vertical connectivity as exemplified by perforations 18a, 18b. A constant pressure in a given wellbore chamber is indicative that the casing perforation of the wellbore chamber is not in fluid communication with any fractures.

Accordingly, with reference to FIGS. 1A, 2, 3, and 4, the third and fourth rates of pressure change in the third and fourth wellbore chambers 52c, 52d are observed to be relatively high due to the development of an interconnected fracture network 28 forming a vertical fracture plane. In contrast, the first rate of pressure change in the first wellbore chamber 52a is relatively low due to limited development of the fracture network 26 therein and its lack of interconnections with the other fracture network 28 in the fracture plane. The second rate of pressure change in the second wellbore chamber 52b is even lower due to the lack of any fracture network development at all. The present evaluation suggests that the fracture treatment has been ineffective with respect to the first two perforations 18a, 18b producing fractures having insufficient length, width, conductivity, and/or vertical coverage. Therefore, perforations 18a, 18b are likely candidates for terracing. The analysis can also be used simply as a method of acquiring empirical fracture data to improve fracture simulation models and post-fracture pressure transient analytical models.

The following example demonstrates the practice and utility of the present invention, but is not to be construed as limiting the scope thereof.

EXAMPLE

Figure 5:
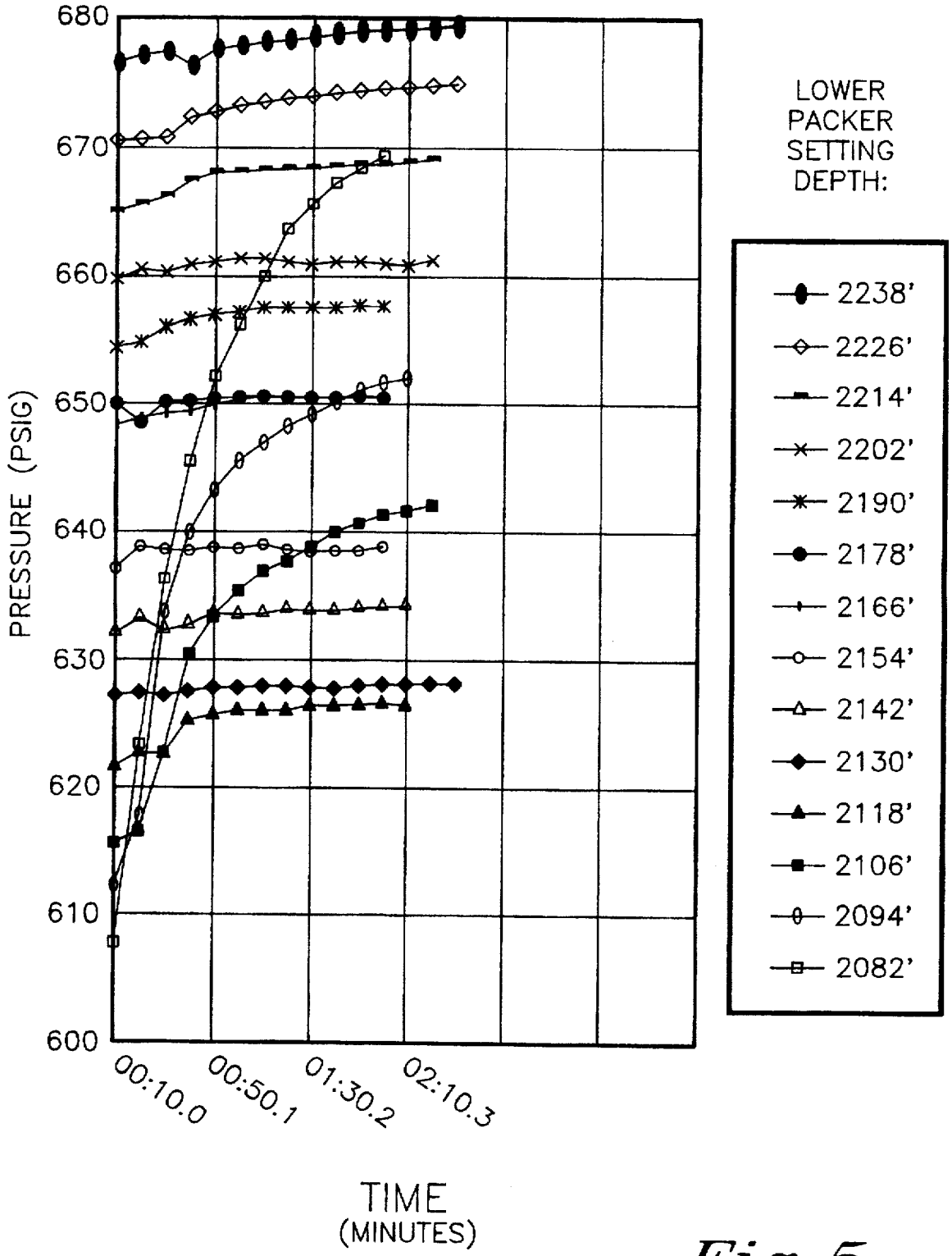
FIG. 5 is a graph plotting pressure values versus time to provide pressure profiles for a plurality of wellbore chambers established in the manner of the present invention.

A completed hydrocarbon production well having undergone a hydraulic fracture treatment is selected, wherein a pressure differential exists between the wellbore and the formation penetrated thereby. A non-damaging kill fluid is injected into the wellbore to kill the well and a dual packer assembly is positioned at the bottom of the production interval. The packer assembly is operated in accordance with the method of the present invention, establishing a first wellbore chamber and recording pressure values therein for a time period of two minutes. Additional wellbore chambers are sequentially established thereafter at 12 feet intervals and pressure values are recorded in each of these chambers for two minute time intervals. The pressure values are plotted against time for each wellbore chamber designated by the depth of the lower packer, wherein the distance between the lower and upper packers is maintained at 15 feet throughout the method. Pressure profiles are produced thereby for each wellbore chamber, a series of which are shown in FIG. 5 for a lower packer depth range between 2238 and 2082 feet. The pressure data of FIG. 5 are tabulated in the table below:

| Lower Packer Depth (ft) | Final Pressure (psig) | Rate of Pressure Change (psi/min) |
|---|---|---|
| 2238 | 679 | 1.20 |
| 2226 | 675 | 1.89 |
| 2214 | 669 | 1.97 |
| 2202 | 661 | 0.70 |
| 2190 | 658 | 1.77 |
| 2178 | 651 | 0.46 |
| 2166 | 651 | 1.78 |
| 2154 | 639 | 0.84 |
| 2142 | 634 | 1.09 |
| 2130 | 628 | 0.40 |
| 2118 | 627 | 2.49 |
| 2106 | 642 | 12.1 |
| 2094 | 652 | 19.9 |
| 2082 | 670 | 33.6 |

Figure 6:
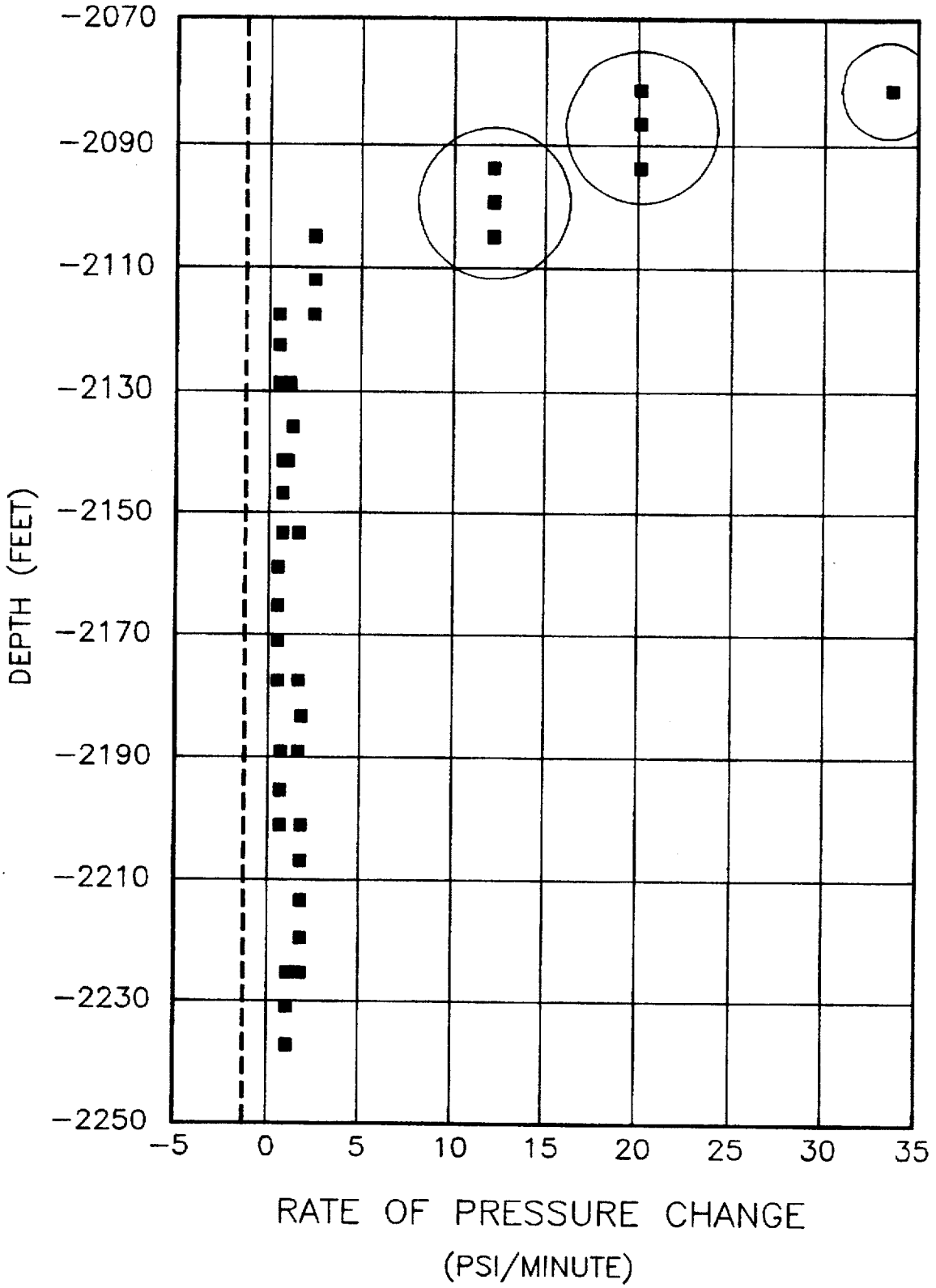
FIG. 6 is a graph plotting the rate of pressure change versus lower packer depth for a plurality of wellbore chambers established in the manner of the present invention.

FIG. 6 is a plot of the rate of pressure change versus depth indicating that the highest quality fractures are in fluid communication with casing perforations at depths between 2106 and 2091 feet, 2094 and 2079 feet, and 2082 and 2067 feet, respectively. It is noted that the overall rate of pressure change in the wellbore fluid column is −0.5 psi/min as shown by the dashed vertical line in FIG. 6.

While foregoing preferred embodiments of the invention have been described and shown, it is understood that alternatives and modifications, such as those suggested and others, may be made thereto and fall within the scope of the invention. For example, it is apparent to the skilled artisan that, although the specific configuration of the packer assembly 32 shown herein has utility in the present invention, the invention is not limited to this specific configuration. Substantially any packer assembly may be employed in the present invention, wherein lower and upper packers are provided to enable direct fluid and pressure isolation of each wellbore chamber. It is further apparent that the pressure measuring device 44 is not required to be in engagement with the dual packer assembly 32 as shown herein, but can alternatively be positioned substantially anywhere in a wellbore chamber where the instantaneous pressure value at any given time is substantially at equilibrium.

Although the wellbore 10 and its associated casing 16 are shown herein to have only a limited number of vertically spaced perforations 18*a*, 18*b*, 18*c*, 18*d* and each wellbore chamber 52*a*, 52*b*, 52*c*, 52*d* is shown to enclose only a single casing perforation, it is understood that the casing 16 can have a plurality of additional vertically or radially spaced perforations and that each wellbore chamber 52*a*, 52*b*, 52*c*, 52*d* can enclose a plurality of such perforations in series. The method is preferably practiced such that upon completion, all of the casing perforations have been included within one and only one wellbore chamber. Accordingly, the wellbore chambers are selected sequentially along substantially the entire length of the production interval in correspondence with one or more casing perforations and pressure values are obtained for each wellbore chamber in the above-described manner.

It is further noted that the present invention has been described above in the context of a vertical wellbore, wherein points within the wellbore are identified with reference to their relative vertical positions. It is apparent, however, that the instant description is readily applicable to horizontal wellbores, wherein the relative vertical positions of the points are translated to relative horizontal positions. Accordingly, the terms upper and lower, as used in the context of a vertical wellbore, are interchangeable with the terms forward and rearward, as used in the context of a horizontal wellbore.

I claim:

1. A method for evaluating a fracture treatment comprising:

a) providing a wellbore penetrating a subterranean hydrocarbon-bearing formation, wherein a pressure differential exists between said wellbore and said formation, and further wherein said formation and said wellbore are bounded by a wellbore face of a production or injection interval across which said formation and said wellbore fluid communicate, said formation having at least one fracture formed therein;

b) placing a first fluid seal across a first cross-section of said wellbore at a first point of said wellbore face in said production or injection interval to block fluid flow across said first cross-section;

c) placing a second fluid seal across a second cross-section of said wellbore at a second point of said wellbore face in said production or injection interval spaced a first wellbore distance from said first point to block fluid flow across said second cross-section, wherein said first and second seals define a wellbore chamber bounded by said first and second seals and a segment of said wellbore face positioned between said first and second points;

d) measuring a plurality of pressure values in said wellbore chamber over a period of time to obtain a pressure rate for said wellbore chamber;

e) repeating steps b) through d) at at least one different sequential pair of points in said production or injection interval to define a plurality of wellbore chambers across the length of said production or injection interval in said wellbore; and f) comparing said pressure rates for said wellbore chambers to determine whether each of said wellbore chambers is in fluid communication with said fracture.

2. The method of claim 1, wherein said lower seal is a packer.

3. The method of claim 1, wherein said upper seal is a packer.

4. The method of claim 1, wherein said lower and upper seals are integrally connected in a dual packer assembly.

5. The method of claim 1 further comprising repeating steps b) through d) at a plurality of different pairs of lower and upper points in said wellbore to define a plurality of sequential wellbore chambers across substantially the entire length of a production or injection interval in said wellbore.

6. The method of claim 1, wherein said wellbore has a casing positioned at said wellbore face, said casing having a plurality of perforations formed therethrough.

7. The method of claim 6, wherein each of said wellbore chambers contains a different perforation of said plurality of perforations.

8. The method of claim 1, wherein a first of said pressure rates is substantially greater than a second of said pressure rates, thereby indicating said wellbore chamber having said first of said pressure rates has a higher degree of fluid communication with said formation via said fracture than said wellbore chamber having said second of said pressure rates.

9. A method for evaluating the degree of fluid communication between a subterranean formation and a wellbore penetrating the formation comprising:

a) providing a wellbore penetrating a subterranean hydrocarbon-bearing formation and bounding said formation at a wellbore face, wherein said wellbore is segmented into a plurality of wellbore chambers, including a first and a second wellbore chamber, and said wellbore face is segmented into a plurality of wellbore face segments, including a first and a second wellbore face segment, each of said wellbore face segments having a lower bound and an upper bound and each of said wellbore face segments corresponding to one of said wellbore chambers, and further wherein said formation fluid communicates with each said wellbore chamber across said corresponding wellbore face segment and a pressure differential exists between said wellbore and said formation;

b) placing a lower fluid seal across a first lower cross-section of said wellbore at said lower bound of said first wellbore face segment to block fluid flow across said first lower cross-section;

c) placing an upper fluid seal across a first upper cross-section of said wellbore at said upper bound of said first wellbore face segment to block fluid flow across said second cross-section, wherein said lower and upper seals bound said first wellbore chamber;

d) measuring a plurality of first pressure values in said first wellbore chamber over a first time period to obtain a first pressure rate, while maintaining fluid communication between said formation and each of said wellbore chambers across said corresponding wellbore face segments;

e) repositioning said lower and upper seals to said lower and upper bounds of said second wellbore face segment, wherein said lower and upper seals bound said second wellbore chamber;

f) measuring a plurality of second pressure values in said second wellbore chamber over a second time period to obtain a second pressure rate, while maintaining fluid communication between said formation and each of said wellbore chambers across said corresponding wellbore face segments; and g) comparing said first pressure rate to said second pressure rate.

10. The method of claim 9 further comprising:

repositioning said lower and upper seals to said lower and upper bounds of said third wellbore face segment, wherein said lower and upper seals bound said third wellbore chamber;

measuring a plurality of third pressure values in said third wellbore chamber over a third time period to obtain a third pressure rate, while maintaining fluid communication between said formation and each of said wellbore chambers across said corresponding wellbore face segments; and comparing said third pressure rate to said first and second pressure rates.

11. The method of claim 9, wherein said upper bound of said first wellbore face segment is between said lower bound of said first wellbore face segment and said lower bound of said second wellbore face segment.

12. The method of claim 9, wherein said second wellbore chamber is substantially adjacent to said first wellbore chamber.

13. The method of claim 10, wherein said upper bound of said first wellbore face segment is between said lower bound of said first wellbore face segment and said lower bound of said second wellbore face segment and said upper bound of said second wellbore face segment is between said lower bound of said second wellbore face segment and said lower bound of said third wellbore face segment.

14. The method of claim 10, wherein said second wellbore chamber is substantially adjacent to said first wellbore chamber and said third wellbore chamber is substantially adjacent to said second wellbore chamber.

15. The method of claim 9 further comprising repeating steps f) through h) at all of said plurality of wellbore chambers across substantially the entire length of a production or injection interval in said wellbore.

16. The method of claim 9, wherein said wellbore has a casing positioned at said wellbore face, said casing having a plurality of perforations formed therethrough.

17. The method of claim 16, wherein said first wellbore chamber contains a first perforation and said second wellbore chamber contains a second perforation.

18. The method of claim 15, wherein said wellbore has a casing positioned at said wellbore face, said casing having a plurality of perforations formed therethrough.

19. The method of claim 18, wherein each of said plurality of wellbore chambers contains one or more different perforations.

20. The method of claim 9, wherein said first pressure rate is substantially greater than said second pressure rate, thereby indicating said first wellbore chamber has a higher degree of fluid communication with said formation and than said second wellbore chamber.

* * * * *